US010473110B2

(12) United States Patent
Iizuka et al.

(10) Patent No.: US 10,473,110 B2
(45) Date of Patent: Nov. 12, 2019

(54) CENTRIFUGAL COMPRESSOR HAVING EQUALIZING VENT TO PREVENT GREASE FROM BEING PUSHED OUT OF A BEARING

(71) Applicant: IHI Corporation, Koto-ku (JP)

(72) Inventors: Kuniaki Iizuka, Tokyo (JP); Takashi Yoshida, Tokyo (JP); Tatsumi Inomata, Tokyo (JP); Takuya Ozasa, Tokyo (JP); Kouta Kimachi, Tokyo (JP)

(73) Assignee: IHI Corporation, Koto-ku (JP)

( * ) Notice: Subject to any disclaimer, the term of this patent is extended or adjusted under 35 U.S.C. 154(b) by 0 days.

(21) Appl. No.: 15/937,058

(22) Filed: Mar. 27, 2018

(65) Prior Publication Data

US 2018/0209436 A1 Jul. 26, 2018

Related U.S. Application Data

(63) Continuation of application No. PCT/JP2016/078661, filed on Sep. 28, 2016.

(30) Foreign Application Priority Data

Oct. 2, 2015 (JP) ..... 2015-196471

(51) Int. Cl.
*F04D 29/12* (2006.01)
*F04D 29/04* (2006.01)
(Continued)

(52) U.S. Cl.
CPC ..... *F04D 29/122* (2013.01); *F04D 17/08* (2013.01); *F04D 25/06* (2013.01); *F04D 29/023* (2013.01);
(Continued)

(58) Field of Classification Search
CPC .... F04D 29/122; F04D 29/42; F04D 25/0626; F04D 17/08; F04D 29/002; F04D 29/04;
(Continued)

(56) References Cited

U.S. PATENT DOCUMENTS 3,494,292 A * 2/1970 Walker ..... F04D 7/06 277/400
6,065,297 A * 5/2000 Tischer ..... F04D 29/063 62/471
(Continued)

FOREIGN PATENT DOCUMENTS

CN 101377204 A 3/2009
DE 103 25 077 A1 10/2004
(Continued)

OTHER PUBLICATIONS

Office Action dated Oct. 9, 2018 in corresponding Japanese Patent Application No. 2017-543502 (with English Translation), 7 pages.
(Continued)

*Primary Examiner* — Bryan M Lettman
*Assistant Examiner* — Timothy P Solak
(74) *Attorney, Agent, or Firm* — Oblon, McClelland, Maier & Neustadt, L.L.P.

(57) ABSTRACT

A centrifugal compressor including: a impeller; a wall portion having an opposed surface that is spaced apart from and opposed to a back surface of the impeller; an insertion hole, which is formed in the wall portion, and is configured to receive a shaft inserted into the insertion hole; a bearing, which is provided in the insertion hole or apart from the impeller with respect to the insertion hole, and is configured to axially support the shaft through interposition of grease being a lubricant inside; an electric motor which is provided on a side opposite to the impeller over the wall portion; and an opposed hole, which is formed in the wall portion, is
(Continued)

disclosed. The opposed hole has one end opened in the opposed surface and another end opened at a position opposed to a stator of the electric motor on a side opposite to the impeller.

8 Claims, 2 Drawing Sheets

(51) Int. Cl.

| | |
|---|---|
| ***F04D 29/10*** | (2006.01) |
| ***F04D 29/16*** | (2006.01) |
| ***F04D 29/58*** | (2006.01) |
| ***F04D 17/08*** | (2006.01) |
| ***F04D 25/06*** | (2006.01) |
| ***F04D 29/02*** | (2006.01) |
| ***F04D 29/053*** | (2006.01) |
| ***F04D 29/063*** | (2006.01) |
| ***F04D 29/42*** | (2006.01) |
| *F04D 29/056* | (2006.01) |

(52) U.S. Cl.
CPC ..... *F04D 29/04* (2013.01); *F04D 29/053* (2013.01); *F04D 29/063* (2013.01); *F04D 29/102* (2013.01); *F04D 29/162* (2013.01); *F04D 29/4206* (2013.01); *F04D 29/582* (2013.01); *F04D 25/0606* (2013.01); *F04D 29/056* (2013.01)

(58) Field of Classification Search
CPC ..... F04D 29/041; F04D 29/05; F04D 29/58; F04D 29/051
See application file for complete search history.

(56) References Cited

U.S. PATENT DOCUMENTS

| | | | | |
|---|---|---|---|---|
| 6,102,672 | A * | 8/2000 | Woollenweber .... | F04D 29/5806 417/366 |
| 2004/0119239 | A1* | 6/2004 | Cardenas ..... | F04D 29/059 277/417 |
| 2007/0039878 | A1* | 2/2007 | Roberts ..... | B01F 3/04609 210/605 |
| 2009/0133431 | A1* | 5/2009 | Nakazeki ..... | F01D 15/005 62/402 |
| 2014/0144412 | A1 | 5/2014 | An et al. | |

FOREIGN PATENT DOCUMENTS

| | | |
|---|---|---|
| EP | 2 952 748 A1 | 12/2015 |
| JP | 55-146829 | 10/1980 |
| JP | 62-114103 | 7/1987 |
| JP | 64-015497 | 1/1989 |
| JP | 2008-240605 | 10/2008 |
| JP | 2009-091935 | 4/2009 |
| JP | 2009-097519 | 5/2009 |
| JP | 2011-111923 | 6/2011 |
| JP | 4812367 | 11/2011 |
| JP | 2012-017712 | 1/2012 |
| JP | 2013-024041 | 2/2013 |

OTHER PUBLICATIONS

International Preliminary Report on Patentability and Written Opinion dated Apr. 12, 2018 in PCT/JP2016/078661 (English Translation only), 7 pages.
International Search Report dated Dec. 20, 2016 in PCT/JP2016/078661 filed Sep. 28, 2016 (with English Translation).
Written Opinion dated Dec. 20, 2016 in PCT/JP2016/078661 filed Sep. 28, 2016.
Combined Chinese Office Action dated Mar. 18, 2019 in Chinese Patent Application No. 201680058145.4 (with English translation and English translation of Category of Cited Documents), 14 pages.
Extended European Search Report dated Mar. 28, 2019 in European Patent Application No. 16851653.2, 9 pages.

* cited by examiner

CENTRIFUGAL COMPRESSOR HAVING EQUALIZING VENT TO PREVENT GREASE FROM BEING PUSHED OUT OF A BEARING

CROSS REFERENCE TO RELATED APPLICATIONS

This application is a continuation application of International Application No. PCT/JP2016/078661, filed on Sep. 28, 2016, which claims priority to Japanese Patent Application No. 2015-196471, filed on Oct. 2, 2015, the entire contents of which are incorporated by reference herein.

BACKGROUND ART

Technical Field

The present disclosure relates to a centrifugal compressor in which a shaft is axially supported by a bearing.

Related Art

Hitherto, there has been known an electric supercharger that includes an electric motor and a centrifugal compressor. A rotor is mounted to a shaft. A stator is provided on a housing side. The shaft is driven to rotate by a mutual force between the rotor and the stator. An impeller is provided to the shaft. When the shaft is rotated by the electric motor, the impeller is rotated together with the shaft. With this action, the electric supercharger compresses air along with the rotation of the impeller and delivers the compressed air to an engine.

For example, as described in Patent Literature 1 (Japanese Patent Application Laid-Open No. 2013-24041), in an electric supercharger, air is sucked through an intake port of a housing. The sucked air flows to a front surface side of the impeller in the housing. The air having been increased in pressure and increased in speed in the course of flowing through the impeller is reduced in speed and increased in pressure in the course of flowing through a diffuser flow passage. The diffuser flow passage is formed on a radially outer side of the impeller.

CITATION LIST

Patent Literature

Patent Literature 1: Japanese Patent Application Laid-Open No. 2013-24041

SUMMARY

Technical Problem

Incidentally, the shaft of the centrifugal compressor of the electric supercharger described above is axially supported by a bearing. The bearing is arranged on a back surface side of the impeller. A gap formed between the back surface of the impeller and a wall portion of the housing communicates with the above-mentioned diffuser flow passage. In some cases, part of air may leak from the diffuser flow passage toward the gap formed on the back surface side of the impeller. For example, in the electric supercharger, the gap formed on the back surface side of the impeller communicates with an inside of the housing. The electric motor is received in the housing. The air having leaked to the gap formed on the back surface side of the impeller flows out to the electric motor side in accordance with a pressure difference between the diffuser flow passage and the inside of the housing. At this time, the air flowing out to the electric motor side passes through the bearing. For example, when a large pressure difference is given depending on an engine specification, there is a risk in that the flow of air causes part of grease provided in the bearing to escape to an outside of the bearing, with the result that bearing performance is degraded.

It is an object of the present disclosure to provide a centrifugal compressor that is capable of reducing the escape of the grease provided in the bearing to suppress degradation in bearing performance.

Solution to Problem

In order to solve the above-mentioned problem, according to one embodiment of the present disclosure, there is provided a centrifugal compressor, including: an impeller which is provided to a shaft; a wall portion having an opposed surface that is spaced apart from and opposed to a back surface of the impeller; an insertion hole, which is formed in the wall portion, and is configured to receive the shaft inserted to the insertion hole; a bearing, which is provided in the insertion hole or apart from the impeller with respect to the insertion hole, and is configured to axially support the shaft through interposition of grease being a lubricant inside; an electric motor which is provided on a side opposite to the impeller over the wall portion; and an opposed hole, which is formed in the wall portion, and has one end opened in the opposed surface and another end opened at a position opposed to a stator of the electric motor on a side opposite to the impeller.

The opposed hole may have a plurality of opening portions on the opposed surface side, and the plurality of opening portions may be formed apart in a circumferential direction of the shaft.

The opposed hole includes one or a plurality of opposed holes, and a sum total of an opening area at the one end may be larger than an area of a gap formed in the opposed surface between an inner circumferential surface of the insertion hole and the shaft or a rotary member rotated integrally with the shaft.

A seal ring may be provided between the insertion hole and the shaft on the impeller side with respect to the bearing.

The impeller may be made of fiber reinforced plastic, and the shaft may be made of stainless steel.

Effects of Disclosure

According to the present disclosure, it is possible to reduce the escape of the grease provided in the bearing to suppress degradation in bearing performance.

DESCRIPTION OF EMBODIMENT

Figure 1:
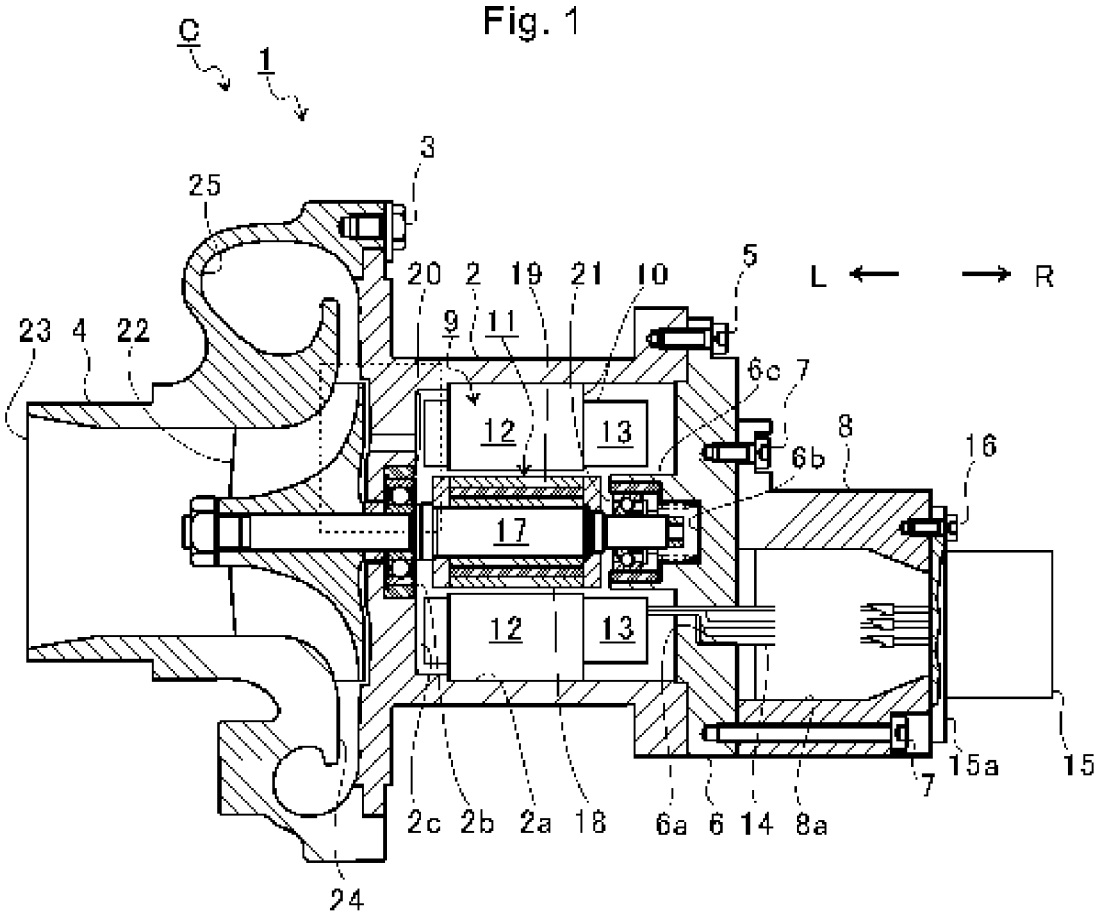
FIG. 1 is a schematic sectional view of an electric supercharger (centrifugal compressor).

Now, with reference to the attached drawings, an embodiment of the present disclosure is described in detail. The dimensions, materials, and other specific numerical values represented in the embodiment are merely examples used for facilitating the understanding of the disclosure, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a schematic sectional view of an electric supercharger C (centrifugal compressor). In the following description, the direction indicated by the arrow L illustrated in FIG. 1 corresponds to a left side of the electric supercharger C, and the direction indicated by the arrow R illustrated in FIG. 1 corresponds to a right side of the electric supercharger C. As illustrated in FIG. 1, the electric supercharger C includes a turbocharger main body 1. The turbocharger main body 1 includes a motor housing 2. A compressor housing 4 is coupled to the left side of the motor housing 2 by a fastening bolt 3. A plate member 6 is coupled to the right side of the motor housing 2 by a fastening bolt 5. A cord housing 8 is coupled to the right side of the plate member 6 by a fastening bolt 7. The motor housing 2, the compressor housing 4, the plate member 6, and the cord housing 8 are integrated.

In the motor housing 2, there is formed a motor hole 2*a* that is opened on the right side in FIG. 1. In the motor hole 2*a*, an electric motor 9 is received. The electric motor 9 includes a stator 10 and a rotor 11. The stator 10 is formed by winding coils 13 on a stator core 12. The stator core 12 has a cylindrical shape.

A plurality of coils 13 are arranged in a circumferential direction of the stator core 12. The coils 13 are arranged in the order of U-phase, V-phase, and W-phase being phases of supplied alternate-current power. Lead wires 14 are provided to the U-phase, the V-phase, and the W-phase, respectively. One end of each of the lead wires 14 is coupled to each of the coils 13 of the U-phase, the V-phase, and the W-phase. The lead wires 14 supply the alternate-current power to the coils 13.

Further, the stator core 12 is inserted to the motor hole 2*a* from an opening side of the motor hole 2*a*. The stator core 12 is mounted in the motor hole 2*a*. An opening of the motor hole 2*a* on the right side is closed by the plate member 6. The cord housing 8 coupled to the plate member 6 has a cord hole 8*a*. The cord hole 8*a* penetrates in a right-and-left direction in FIG. 1. One end of the cord hole 8*a* is closed by the plate member 6. A plate hole 6*a* is formed in the plate member 6. The motor hole 2*a* and the cord hole 8*a* communicate with each other through the plate hole 6*a*. The lead wires 14 extend from the coils 13 to the cord hole 8*a* through the plate hole 6*a*.

The lead wires 14 are received in the cord hole 8*a*. Another end of each of the lead wires 14 on a side opposite to each of the coils 13 is coupled to a connector 15. The connector 15 has a flange portion 15*a*. The flange portion 15*a* closes another end of the cord hole 8*a* of the cord housing 8. The flange portion 15*a* is mounted to the cord housing 8 by a fastening bolt 16. The alternate-current power is supplied to the coils 13 of the stator 10 through the connector 15 and the lead wires 14. The stator 10 functions as an electromagnet.

Further, the rotor 11 is mounted to the shaft 17. The shaft 17 is inserted into the rotor 11. The rotor 11 has a gap with respect to the stator core 12 in a radial direction of the shaft 17. Specifically, the rotor 11 includes a rotor core 18. The rotor core 18 is a cylindrical member. The rotor core 18 has a hole penetrating in an axial direction of the shaft 17. A magnet 19 (permanent magnet) is received in the hole of the rotor core 18. The electric motor 9 generates a driving force in the rotation direction for the shaft 17 by a mutual force generated between the rotor 11 and the stator 10.

The shaft 17 is inserted into the insertion hole 2*b* of the motor housing 2. The insertion hole 2*b* penetrates in the axial direction of the shaft 17 through a wall portion 2*c* forming a bottom surface of the motor hole 2*a*. A ball bearing 20 (bearing) is arranged in the insertion hole 2*b*. The shaft 17 is axially supported by the ball bearing 20.

One end side of the shaft 17 protrudes toward the plate member 6 side with respect to the rotor 11. One end of the shaft 17 is inserted to a boss hole 6*b*. The boss hole 6*b* is formed in the plate member 6. An annular protrusion 6*c* is formed on the plate member 6. The annular protrusion 6*c* protrudes into the motor hole 2*a*. The annular protrusion 6*c* forms a part of an outer wall forming the boss hole 6*b*. A ball bearing 21 is arranged in the boss hole 6*b*. The shaft 17 is axially supported by the ball bearing 21.

Another end side of the shaft 17 protrudes from the insertion hole 2*b* into the compressor housing 4. On the another end side of the shaft 17, a compressor impeller 22 (impeller) is provided. The compressor impeller 22 is received in the compressor housing 4 so as to be rotatable. The electric motor 9 is provided on a side opposite to the compressor impeller 22 over the wall portion 2*c*.

The compressor housing 4 has an intake port 23. The intake port 23 is opened on the left side of the electric supercharger C. The intake port 23 is connected to an air cleaner (not shown). Under a state in which the motor housing 2 and the compressor housing 4 are coupled to each other by the fastening bolt 3, a diffuser flow passage 24 is formed. The diffuser flow passage 24 is formed by opposed surfaces of the motor housing 2 and the compressor housing 4. The diffuser flow passage 24 increases the air in pressure. The diffuser flow passage 24 is annularly formed so as to extend from a radially inner side to a radially outer side of the shaft 17. The diffuser flow passage 24 communicates with the intake port 23 on the above-mentioned radially inner side through intermediation of the compressor impeller 22.

An annular compressor scroll flow passage 25 is provided to the compressor housing 4. The compressor scroll flow passage 25 is positioned on the radially outer side of the shaft 17 with respect to the diffuser flow passage 24. The compressor scroll flow passage 25 communicates with an intake port of an engine (not shown). The compressor scroll flow passage 25 communicates also with the diffuser flow passage 24.

The driving force generated by the electric motor 9 causes the compressor impeller 22 to rotate. The rotation of the compressor impeller 22 causes air to be sucked into the compressor housing 4. The air is sucked through the intake port 23 in the axial direction of the shaft 17. The sucked air is increased in pressure and increased in speed by an action of a centrifugal force in the course of flowing through between blades of the compressor impeller 22. The air having been increased in pressure and increased in speed is delivered to the diffuser flow passage 24 and the compressor scroll flow passage 25. The delivered air is reduced in speed and increased in pressure (compressed) in the diffuser flow passage 24 and the compressor scroll flow passage 25. The air having been increased in pressure is led to the intake port of the engine.

Figure 2:
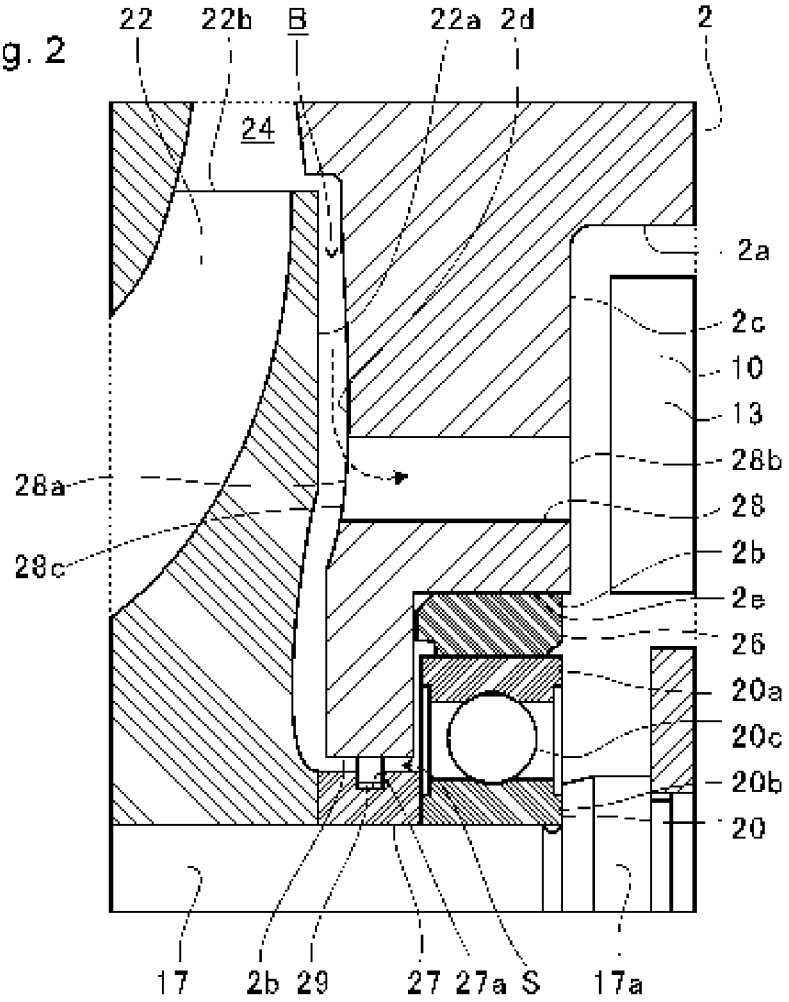
FIG. 2 is an extraction view of the broken line portion of FIG. 1.

FIG. 2 is an extraction view of the broken line portion of FIG. 1. As illustrated in FIG. 2, a back surface 22*a* is a surface of the compressor impeller 22 on a side opposite to the above-mentioned intake port 23. The back surface 22*a* faces a space B.

An opposed surface 2*d* is a surface of the wall portion 2*c* of the motor housing 2, which is opposed to the compressor impeller 22. The opposed surface 2*d* is spaced apart from the back surface 22*a* of the compressor impeller 22 in the axial direction of the shaft 17. The space B is formed so as to have the back surface 22*a* of the compressor impeller 22 and the opposed surface 2*d* of the wall portion 2*c* of the motor housing 2 as inner walls. That is, the space B is formed between the back surface 22*a* of the compressor impeller 22 and the opposed surface 2*d*. The space B communicates with the diffuser flow passage 24 in the vicinity of a downstream end 22*b* of the compressor impeller 22. The downstream end 22*b* of the compressor impeller 22 is an end portion of the compressor impeller 22 on the radially outer side.

The opposed surface 2*d* of the motor housing 2 has the insertion hole 2*b* opened therein. As described above, the shaft 17 is inserted into the insertion hole 2*b*. The shaft 17 is axially supported by the ball bearing 20 arranged in the insertion hole 2*b*.

In an inner circumferential surface of the insertion hole 2*b*, there is formed an enlarged diameter portion 2*e*. The enlarged diameter portion 2*e* is formed on the motor hole 2*a* side in the inner circumferential surface of the insertion hole 2*b*. The enlarged diameter portion 2*e* has an inner diameter larger than that on the compressor impeller 22 side. A first spacer 26 is inserted to the enlarged diameter portion 2*e*. The first spacer 26 is a cylindrical member. The ball bearing 20 is inserted on an inner circumference side of the first spacer 26. The ball bearing 20 is received in the enlarged diameter portion 2*e* through intermediation of the first spacer 26.

The ball bearing 20 includes an outer ring 20*a*, an inner ring 20*b*, and a plurality of rolling elements 20*c* (balls). The plurality of rolling elements 20*c* are arranged between the outer ring 20*a* and the inner ring 20*b*. The ball bearing 20 is a bearing of a grease-sealed type. Grease is interposed as a lubricant in the ball bearing 20, that is, between the rolling elements 20*c*, and the outer ring 20*a* and the inner ring 20*b*.

The outer ring 20*a* is fitted to the first spacer 26. The outer ring 20*a*, for example, has a small radial gap with respect to the first spacer 26. The inner ring 20*b*, for example, is mounted to the shaft 17 by a compression stress (axial force) acting in the axial direction of the shaft 17.

The shaft 17 has a large-diameter portion 17*a*. The large-diameter portion 17*a* protrudes in the radial direction. The inner ring 20*b* is held in abutment against the large-diameter portion 17*a* in the axial direction. A second spacer 27 (rotary member) is arranged between the compressor impeller 22 and the inner ring 20*b*. The second spacer 27 is a cylindrical member. The shaft 17 is inserted on a radially inner side of the second spacer 27. The second spacer 27 is opposed to the inner circumferential surface of the insertion hole 2*b* in the radial direction. A fastening bolt is fastened to an end portion of the shaft 17 on the compressor impeller 22 side. The inner ring 20*b*, the second spacer 27, and the compressor impeller 22 are sandwiched between the large-diameter portion 17*a* and the fastening bolt. Those members are mounted to the shaft 17 by an axial force caused by fastening of the fastening bolt. Those members rotate integrally with the shaft 17.

The space B communicates with the diffuser flow passage 24. Therefore, in some cases, part of the compressed air leaks from the diffuser flow passage 24 to the space B side. The second spacer 27 and the inner circumferential surface of the insertion hole 2*b* are spaced apart in the radial direction of the shaft 17. A gap S is formed between the second spacer 27 and the inner circumferential surface of the insertion hole 2*b*. In the related-art structures, air having leaked to the space B passes through an inside of the ball bearing 20 and flows out to the electric motor 9 side in accordance with a pressure difference between the diffuser flow passage 24 and an inside of the motor housing 2. At that time, when the pressure difference between the diffuser flow passage 24 and the inside of the motor housing 2 is large, there is a fear in that a flow of air causes part of grease provided in the ball bearing 20 to escape to the outside of the ball bearing 20. As a result, the grease provided in the ball bearing 20 is reduced. Accordingly, there is a fear in that the bearing performance is degraded.

Therefore, in this embodiment, the wall portion 2*c* of the motor housing 2 has opposed holes 28. The opposed holes 28 are holes penetrating through the wall portion 2*c* in the axial direction of the shaft 17. One end 28*a* of each of the opposed holes 28 on the compressor impeller 22 side is opened in the opposed surface 2*d*. Another end 28*b* of each of the opposed holes 28 on the electric motor 9 side is opened in the bottom surface of the motor hole 2*a*. The another end 28*b* of each of the opposed holes 28 is opened at each of positions opposed to the stator 10 of the electric motor 9.

The air having leaked from the diffuser flow passage 24 to the space B side flows toward the radially inner side (lower side in FIG. 2) as indicated by the arrow of the broken line in FIG. 2. The air having flowed toward the radially inner side (lower side in FIG. 2) reaches positions opposed to the opposed holes 28. The air having reached the positions opposed to the opposed holes 28 passes through the opposed holes 28 and flows out to the motor hole 2*a* side. That is, before the part of air having leaked from the diffuser flow passage 24 to the space B reaches the gap S between the second spacer 27 and the insertion hole 2*b*, the opposed holes 28 allows the air to be discharged from the space B to the inside of the motor housing 2 in the course of the flow of air toward the insertion hole 2*b*.

As a result, the flow amount of air that passes through the ball bearing 20 via the gap S formed between the second spacer 27 and the insertion hole 2*b* is reduced. The escape of grease from the inside to the outside of the ball bearing 20 due to the flow of air is reduced. Therefore, degradation in bearing performance due to reduction in grease provided in the ball bearing 20 is suppressed.

When air passes through the opposed holes 28, peripheries of the opposed holes 28 are cooled. As a result, the ball bearing 20 is cooled. For example, it is assumed that opening portions of the opposed holes 28 on the opposed surface 2*d* side are formed at positions close to an outer circumferential portion or a side surface portion of the ball bearing 20 with respect to the downstream end 22*b* of the compressor impeller 22 in the radial direction. In this case, the vicinity of the ball bearing 20 is cooled, thereby being capable of further cooling the ball bearing 20. In the case of the bearing of the grease-sealed type, in general, there is a tendency that the lifetime of the bearing is extended as the bearing temperature is low. Therefore, improvement in bearing durability of the ball bearing 20 can be achieved.

Incidentally, the electric supercharger C may be mounted to an engine for an automobile. In this case, changes in rotation of the shaft 17 frequently occur. For example, the rotation speed of the shaft 17 is increased at the time of acceleration of an engine, and then is reduced after elapse of a predetermined time period. The pressure in the diffuser flow passage 24 changes in accordance with the change in rotation of the shaft 17. When the rotation speed of the shaft 17 is increased, the pressure in the diffuser flow passage 24 is increased. The opposed holes 28 allow the part of air having leaked from the diffuser flow passage 24 to the space B to be discharged into the motor housing 2. When the rotation speed of the shaft 17 is reduced, the pressure in the diffuser flow passage 24 is reduced. The opposed holes 28 allow air to be sucked from the inside of the motor housing 2 into the diffuser flow passage 24. That is, when the electric supercharger C is mounted to an engine for an automobile, the changes in rotation of the shaft 17 cause a flow of air reciprocating between the diffuser flow passage 24 and the motor housing 2 through the opposed holes 28. Therefore, cooling of the peripheries of the opposed holes 28 is promoted. The ball bearing 20 is efficiently cooled.

Figure 3:
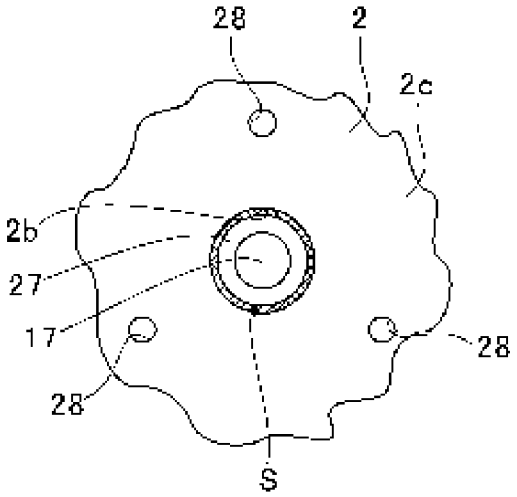
FIG. 3 is an explanatory view for illustrating openings of opposed holes on an opposed surface side.

FIG. 3 is an explanatory view for illustrating openings of the opposed holes 28 on the opposed surface 2*d* side. FIG. 3 is an illustration of the wall portion 2*c* as seen from the left side in FIG. 2. In FIG. 3, an illustration of the compressor impeller 22 is omitted. In FIG. 3, there are illustrated the shaft 17 at the center, and the wall portion 2*c* and the second spacer 27 around the entire circumference of the shaft 17. In FIG. 3, a part of the wall portion 2*c* on the radially outer side of the shaft 17 with respect to the opposed holes 28 is only partially illustrated.

As illustrated in FIG. 3, for example, three opposed holes 28 are formed in a circumferential direction of the shaft 17. The three opposed holes 28 are formed at intervals of approximately 120 degrees in angles about an axial center of the shaft 17. All of the three opposed holes 28 are opened in the opposed surface 2*d* of the wall portion 2*c*. A plurality of (three) opening portions 28*c* (see FIG. 2) of the opposed holes 28 on the opposed surface 2*d* side (one end 28*a* side) are formed apart from each other in the circumferential direction of the shaft 17.

As compared to a case in which only one opening portion 28*c* is formed, air is discharged from the space B in a wider range in the circumferential direction of the shaft 17. The flow of air passing through the ball bearing 20 can be reduced. The opposed holes 28 are holes penetrating through the wall portion 2*c* in the axial direction of the shaft 17. Therefore, processing of forming the opposed holes 28 can easily be performed.

A sum total of opening areas of the three opposed holes 28 on the opposed surface 2*d* side is larger than an opening area of the gap S indicated by cross-hatching in FIG. 3. Therefore, the air having flowed from the diffuser flow passage 24 into the space B is likely to be discharged through the opposed holes 28 in the course of flowing to the gap S. The flow amount of air passing through the ball bearing 20 via the gap S is further reduced. The degradation in bearing performance due to the escape of grease is suppressed.

For example, a portion of each of the opposed holes 28 at which a flow passage cross-sectional area is minimum and a portion of the gap S at which a flow passage cross-sectional area is minimum are compared. In this case, a sum total of the flow passage cross-sectional areas of the three opposed holes 28 may be set larger than the flow passage cross-sectional area of the gap S. A flow passage resistance of the gap S is larger than that of the opposed holes 28. Therefore, the air having flowed from the diffuser flow passage 24 into the space B is likely to be stably discharged through the opposed holes 28.

In the outer circumferential surface of the second spacer 27, a spacer groove 27*a* is formed. The spacer groove 27*a* is annular. A seal ring 29 is press-fitted to a portion of the insertion hole 2*b* which is opposed to the spacer groove 27*a* on the radially outer side. A radially inner side of the seal ring 29 is inserted to the spacer groove 27*a*. The seal ring 29 is provided between the insertion hole 2*b* and the shaft 17 on the compressor impeller 22 side with respect to the ball bearing 20.

With the seal ring 29, the flow amount of air passing through the ball bearing 20 via the gap S is suppressed. The air having flowed from the diffuser flow passage 24 into the space B is more likely to be discharged through the opposed holes 28. Therefore, the flow amount of air passing through the ball bearing 20 is further reduced. The degradation in bearing performance due to the escape of grease is suppressed.

Openings of the opposed holes 28 on the electric motor 9 side (side opposite to the opposed surface 2*d*) are opposed to the stator 10. The stator 10 is cooled by the air passing through the opposed holes 28. As a result, loss caused by heat generation in the stator 10 is reduced.

As a material of a compressor impeller, aluminum alloy is often used. As a material of a shaft, chrome-molybdenum steel is often used. The compressor impeller 22 of this embodiment is made of fiber reinforced plastic having a smaller thermal conductivity than that of the aluminum alloy. The shaft 17 is made of stainless steel having a smaller thermal conductivity than that of the chrome-molybdenum steel. In those cases, strength requested for both the compressor impeller 22 and the shaft 17 can be secured. Further, the quantity of heat transferred from the compressor impeller 22 to the shaft 17 is suppressed. Therefore, the temperature rise in the electric motor 9 is suppressed.

The embodiment has been described above with reference to the attached drawings, but, needless to say, the present disclosure is not limited to the above-mentioned embodiment. It is apparent that those skilled in the art may arrive at various alternations and modifications within the scope of claims, and those examples are understood as naturally falling within the technical scope of the present disclosure.

For example, in the above-mentioned embodiment, description is made of the case in which the plurality of opening portions 28*c* of the opposed holes 28 are formed at substantially equal intervals so as to be spaced apart in the circumferential direction of the shaft 17. However, at least one opening portion 28*c* only needs to be formed. Further, the plurality of opening portions 28*c* may be formed at unequal intervals so as to be spaced apart in the circumferential direction of the shaft 17.

Further, in the above-mentioned embodiment, description is made of the case in which the opposed holes 28 penetrate through the wall portion 2*c* in the axial direction. However, the opposed holes 28 may penetrate through the wall portion 2*c* so as to be inclined with respect to the axial direction of the shaft 17. Further, the opposed holes 28 may be inclined toward the radially inner side from the opposed surface 2*d* side to the wall portion 2*c* side. In this case, the flow of air having leaked from the diffuser flow passage 24 to the space B side is prevented from being significantly shifted. The air smoothly flows into the opposed holes 28.

Further, in the above-mentioned embodiment, description is made of the case in which the opening portions 28*c* of the opposed holes 28 on the opposed surface 2*d* side are formed at positions close to the outer circumferential portion or the side surface portion of the ball bearing 20 with respect to the downstream end 22*b* of the compressor impeller 22 in the radial direction. However, the opening portions 28*c* of the opposed holes 28 on the opposed surface 2*d* side may be formed at positions close to the downstream end 22*b* of the compressor impeller 22 with respect to the outer circumferential portion or the side surface portion of the ball bearing 20 in the radial direction. In this case, for example, when the opposed holes 28 are inclined toward the radially inner side from the opposed surface 2*d* side to the wall portion 2*c* side, a degree of freedom such as flow passage areas or inclination angles of the opposed holes 28 can be significantly secured.

Further, in the above-mentioned embodiment, description is made of the case in which a sum total of the opening areas of the plurality of opposed holes 28 on the opposed surface 2*d* side is larger than an area of the gap S formed between the inner circumferential surface of the insertion hole 2*b* in the opposed surface 2*d* and the second spacer 27. However, the sum total of the opening areas of the plurality of opposed holes 28 on the opposed surface 2*d* side may be equal to or less than the area of the gap S formed between the inner circumferential surface of the insertion hole 2*b* in the opposed surface 2*d* and the second spacer 27.

Further, in the above-mentioned embodiment, description is made of the case in which the seal ring 29 is provided between the insertion hole 2*b* and the shaft 17. However, the seal ring 29 may be omitted.

Further, in the above-mentioned embodiment, description is made of the case in which the second spacer 27 is provided as a rotary member that is opposed to the insertion hole 2*b* in the radial direction on the compressor impeller 22 side with respect to the ball bearing 20. However, the second spacer 27 may be formed integrally with the compressor impeller 22. For example, when the compressor impeller 22 and the inner ring 20*b* of the ball bearing 20 are fastened by means other than the fastening bolt, the second spacer 27 may be omitted. The shaft 17 may be opposed to the insertion hole 2*b* in the radial direction. At that time, a sum total of the opening areas of the plurality of opposed holes 28 on the opposed surface 2*d* side may be set larger than an area of the gap formed between the inner circumferential surface of the insertion hole 2*b* in the opposed surface 2*d* and the shaft 17. With such a configuration, the air having flowed from the diffuser flow passage 24 into the space B is likely to be discharged through the opposed holes 28. Therefore, similarly to the above-mentioned embodiment, the flow of air passing through the ball bearing 20 is reduced. Degradation in bearing performance due to the escape of grease is suppressed.

Further, in the above-mentioned embodiment, description is made of the case in which the compressor impeller 22 is made of fiber reinforced plastic. Description is made of the case in which the shaft 17 is made of stainless steel. However, the compressor impeller 22 may be made of a material other than the fiber reinforced plastic. The shaft 17 may be made of a material other than the stainless steel.

Further, in the above-mentioned embodiment, description is made of the electric supercharger C as an example. However, the above-mentioned configuration may be applied to a centrifugal compressor other than the electric supercharger C.

Further, in the above-mentioned embodiment, description is made of the case in which the ball bearing 20 is provided in the insertion hole 2*b*. However, the present disclosure is not limited to such a configuration as long as the ball bearing 20 is provided between the compressor impeller 22 and the motor housing 2. For example, the ball bearing 20 may be provided apart from the compressor impeller 22 with respect to the insertion hole 2*b*.

INDUSTRIAL APPLICABILITY

The present disclosure is applicable to a centrifugal compressor in which a shaft is axially supported by a bearing.

What is claimed is:

1. A centrifugal compressor, comprising:

an impeller which is provided to a shaft;

a wall portion having an opposed surface that is spaced apart from and opposed to a back surface of the impeller;

an insertion hole, which is formed in the wall portion, and is configured to receive the shaft inserted into the insertion hole;

a bearing, which is provided in the insertion hole or apart from the impeller with respect to the insertion hole, is configured to axially support the shaft, and having grease lubricant inside;

an electric motor which is provided on a side opposite to the impeller over the wall portion; and an opposed hole, which is formed in the wall portion, and has one end opened in the opposed surface and another end opened at a position opposed to a stator of the electric motor on a side opposite to the impeller, wherein the opposed hole comprises one or a plurality of opposed holes, and a sum total of an opening area at the one end is larger than an area of a circumferential gap formed in the opposed surface between an inner circumferential surface of the insertion hole and the shaft or a rotary member rotated integrally with the shaft.

2. A centrifugal compressor according to claim 1, wherein the opposed hole has a plurality of opening portions on the opposed surface side, and the plurality of opening portions are formed apart in a circumferential direction of the shaft.

3. A centrifugal compressor according to claim 2, wherein the impeller is made of fiber reinforced plastic, and the shaft is made of stainless steel.

4. A centrifugal compressor according to claim 2, further comprising a seal ring provided between the insertion hole and the shaft on the impeller side with respect to the bearing.

5. A centrifugal compressor according to claim 4, wherein the impeller is made of fiber reinforced plastic, and the shaft is made of stainless steel.

6. A centrifugal compressor according to claim 1, further comprising a seal ring provided between the insertion hole and the shaft on the impeller side with respect to the bearing.

7. A centrifugal compressor according to claim 6, wherein the impeller is made of fiber reinforced plastic, and the shaft is made of stainless steel.

8. A centrifugal compressor according to claim 1, wherein the impeller is made of fiber reinforced plastic, and the shaft is made of stainless steel.

* * * * *